US007252208B1

(12) United States Patent
Alvino et al.

(10) Patent No.: US 7,252,208 B1
(45) Date of Patent: Aug. 7, 2007

(54) TABLET DISPENSER

(75) Inventors: Frank J. Alvino, Loveladies, NJ (US); Michael L. Turini, Jr., Cranford, NJ (US)

(73) Assignee: Advent Consumer Heathcare LLC, Harvey Cedars, NJ (US)

( * ) Notice: Subject to any disclaimer, the term of this patent is extended or adjusted under 35 U.S.C. 154(b) by 132 days.

(21) Appl. No.: 11/028,408

(22) Filed: Jan. 3, 2005

(51) Int. Cl.
*G07F 11/00* (2006.01)

(52) U.S. Cl. ..... 221/3; 221/28; 221/30; 221/31

(58) Field of Classification Search ..... 221/25, 221/30, 31, 27
See application file for complete search history.

(56) References Cited

U.S. PATENT DOCUMENTS

| | | | | |
|---|---|---|---|---|
| 3,958,690 | A | | 5/1976 | Gee, Sr. |
| 4,078,660 | A | | 3/1978 | Lerro |
| 4,384,649 | A | | 5/1983 | Brodsky |
| 4,420,076 | A | | 12/1983 | Beveridge et al. |
| 4,465,191 | A | | 8/1984 | Darbo |
| 4,765,460 | A | | 8/1988 | Vigueras Pacheco |
| 4,998,623 | A | | 3/1991 | Doull |
| 5,412,372 | A | * | 5/1995 | Parkhurst et al. ..... 340/568.1 |
| 5,431,283 | A | | 7/1995 | Weinstein et al. |
| 5,450,064 | A | * | 9/1995 | Williams et al. ..... 340/574 |
| 5,909,822 | A | * | 6/1999 | George et al. ..... 221/25 |
| 5,950,819 | A | * | 9/1999 | Sellars ..... 206/221 |
| 5,988,429 | A | * | 11/1999 | Coe ..... 221/25 |
| 6,082,544 | A | | 7/2000 | Romick |
| 6,119,864 | A | | 9/2000 | Kessler et al. |
| D433,935 | S | | 11/2000 | Lewis |
| 6,155,409 | A | | 12/2000 | Hettinger |
| 6,155,454 | A | | 12/2000 | George et al. |
| 6,382,410 | B1 | | 5/2002 | Magid et al. |
| 6,386,358 | B1 | | 5/2002 | North et al. |
| 6,390,327 | B1 | | 5/2002 | Cornell |

* cited by examiner

*Primary Examiner*—Gene O. Crawford
*Assistant Examiner*—Timothy Waggoner
(74) *Attorney, Agent, or Firm*—Schweitzer Cornman Gross & Bondell LLP

(57) ABSTRACT

A compact, portable tablet dispenser is particularly adapted for carrying aspirin tablets for ingestion as therapy upon the onset of a suspected heart attack. The tablets are in a blister within the dispenser, which includes actuators aligned with the tablets to eject the tablets through an aperture in the dispenser. Upon operation, the actuators provide a permanent indication that a tablet has been ejected. The dispenser may include electronic circuitry to provide reinforcement and/or guidance, for its use and may include means for alerting a third party, such as by a 911 call, of its activation.

14 Claims, 4 Drawing Sheets

TABLET DISPENSER

The present invention relates to a new and improved tablet dispenser, and to a tablet dispenser particularly designed for portability and for the dispensation of aspirin tablets to be taken by an individual in the case of a suspected heart attack.

BACKGROUND OF THE INVENTION

Scientific evidence is mounting that, for an individual not otherwise allergic to aspirin, the chewing of an aspirin tablet upon the suspected onset of heart attack symptoms may reduce the risk of death. See, generally www.americanheart.org. With the onset of such symptoms, it is important that, if aspirin therapy is appropriate, the aspirin tablet be taken promptly. It is thus of significant value to provide an aspirin holder or dispenser which can be easily carried by an individual and which can be activated simply and quickly, particularly when the user may be in an agitated state. It is also advantageous that the individual be knowledgeable of the steps to be taken, including the taking of the tablet, if a heart attack is suspected, and that the individual have guidance and/or reinforcement of the steps to be taken, particularly since the onset of the symptoms of a heart attack often itself creates a stressful situation. If there is a risk that the individual may panic or otherwise be incapable of taking the needed steps, or if the individual simply feels that further assistance is required, a third-party notification or alarm associated with the dispenser is also of value.

The prior art discloses a variety of tablet and pill dispensers which are of a general configuration which permit them to be carried by an individual. Representative of such teachings are U.S. Pat. Nos. 3,958,690; 4,078,660; 4,384,649; and 4,420,076, among others. In general, however, the prior art fails to provide a portable dispenser, and particularly a dispenser adapted for the prompt dispensation of aspirin tablets having particular features which are beneficial for use in connection with aspirin therapy upon the suspected onset of a heart attack.

It is accordingly a purpose of the present invention to provide a portable tablet dispenser particularly adapted to facilitate the dispensation of an aspirin tablet by an individual for taking in the case of a suspected heart attack.

Yet a further purpose of the present invention is to provide such a dispenser with the ability to provide reinforcement to the individual in connection with approved aspirin therapy at the time of dispensation.

Another purpose of the present invention is to provide a dispenser having the ability to broadcast an alarm or position information to facilitate the locating of the individual and the dispatch of aid thereto.

Still a further purpose of the present invention is to provide such a dispenser that is efficient and economical in manufacture and use.

BRIEF DESCRIPTION OF THE INVENTION

In accordance with the foregoing and other objects and purposes, a tablet dispenser constructed in accordance with the present invention is a small, transportable device in which a blister card-type carrier for one or more tablets, such as aspirin tablets, can be placed. The carrier may preferably be of a modified "clam shell" type, allowing access to the interior of the dispenser for loading of the blister pack.

The dispenser may preferably include integral ejectors associated with each of the pills or tablets to be carried by the dispenser. The ejectors may be located on a first side or surface of the dispenser, their activation driving the associated tablet through an aligned aperture on an opposed side or surface of the dispenser. Each of the ejectors may have a "one way" action to provide a positive indication of use and to provide visual clues that the tablet associated therewith has been previously ejected. With such a construction, it is contemplated that the dispenser can be of a disposable nature, with a "one use" action-preventing refill. Preferably, the ejectors are of a construction which facilitate the discharge of the tablet from the surrounding blister pack, while minimizing the risk of damage to the tablet during ejection.

In alternative embodiments of the invention, the operation of an ejector by the user may trigger the operation of electronic circuitry adapted to enhance the effectiveness of the dispensation. Such enhancements may include, for example, the activation of voice synthesis circuitry to generate oral instructions to the user, and/or the broadcast of an appropriate radio signal to allow the location of the dispenser, and thus the user, to be pinpointed to facilitate the dispatch of medical help. Such enhancements may also be activated independently from tablet dispensation, and may be incorporated into a reusable or refillable construction.

BRIEF DESCRIPTION OF THE DRAWINGS

A fuller understanding of the present invention will be received upon consideration of the following detailed description of preferred, but nonetheless illustrative, embodiments of the invention when reviewed in association with the annexed drawings, wherein.

DETAILED DESCRIPTION OF THE INVENTION

Figure 1:
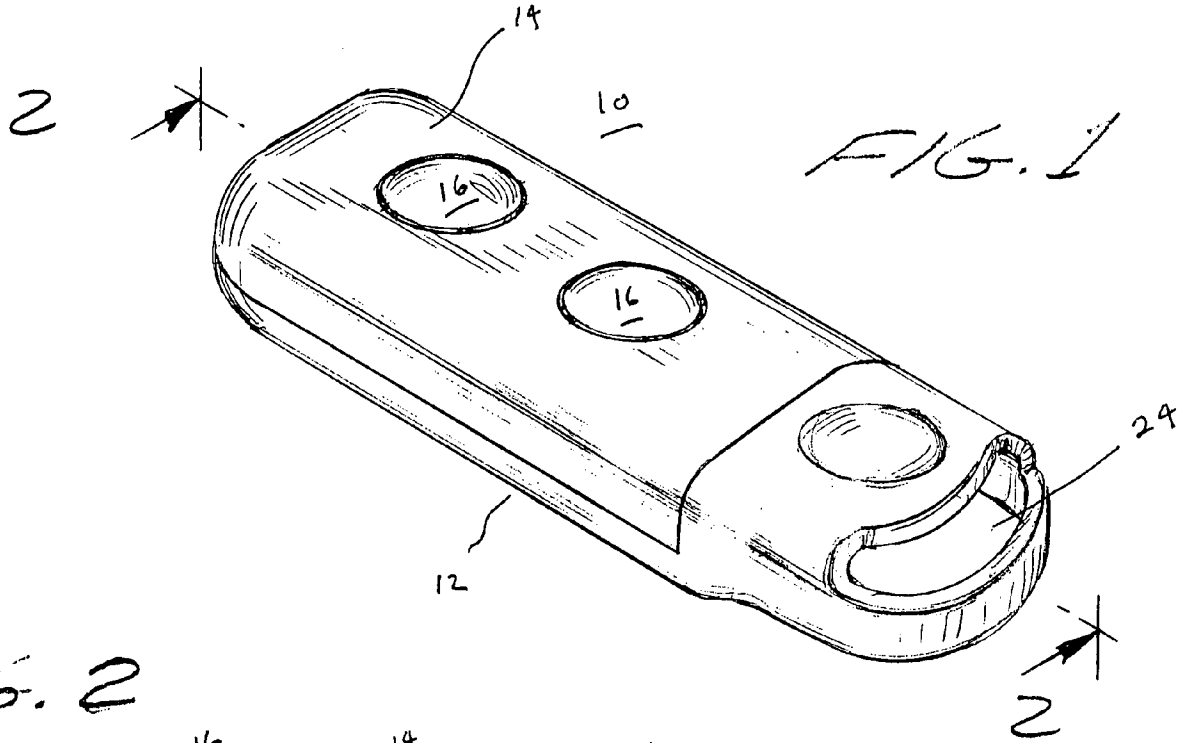
FIG. 1 is a perspective view of a dispenser constructed in accordance with the invention.
Figure 2:
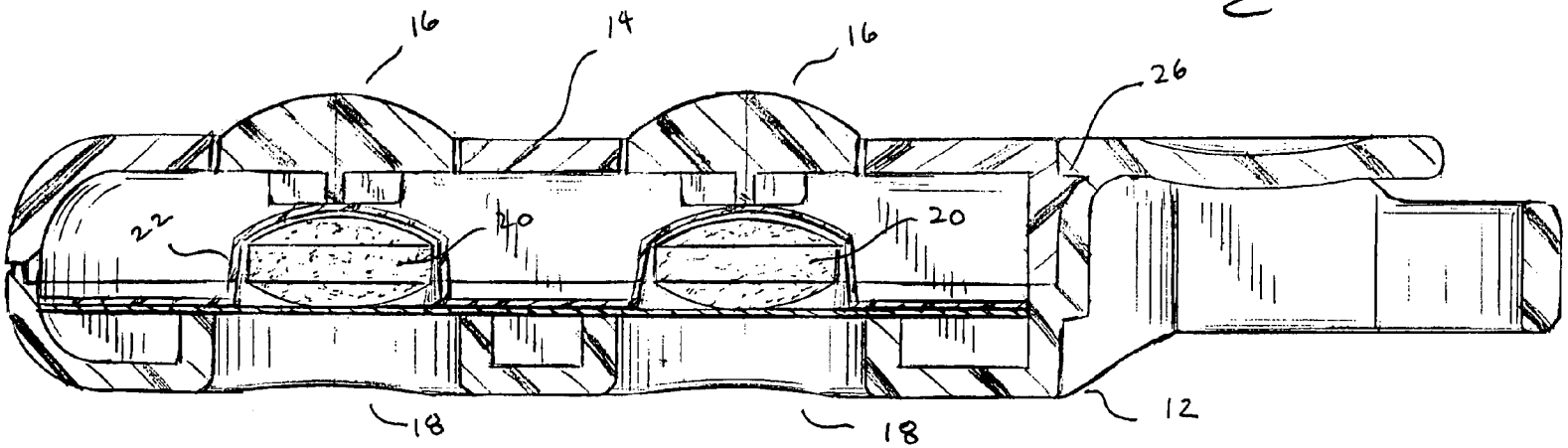
FIG. 2 is a sectional view of the dispenser taken along line 2-2 of FIG. 1.

With initial reference to FIGS. 1 and 2, tablet dispenser 10 may be of generally elongated shape with overall dimensions commensurate with personal transport, to be carried in a pocket, purse, on a key chain, or the like. The overall length of the device may be in the range of three inches. In the embodiment shown, the dispenser is adapted to dispense two tablets.

The dispenser comprises a main base or bottom portion 12 and a cover 14, which may be pivotally attached to the base at a first end thereof, and which form bottom and top walls for the dispenser. The cover carries a pair of ejectors 16 that overlie a corresponding pair of pills or tablets, such as aspirin tablets 20, located within the dispenser within blister packaging 22. As known, a blister pack typically consists of a formed piece of pvc or similar plastic having a series of "blisters" attached to a plastic, paperboard or foil substrate. The blisters accommodate the product to be dispensed. For use in the present invention, the blister pack is of the general type in which the blister can be manually deformed and depressed against the enclosed tablet to cause the tablet to rupture the substrate and drive the tablet out of the pack. A pair of corresponding ejection apertures or ports 18 are formed in the dispenser base 12 through which the tablets 20 pass when dispensed through manual actuation of the ejectors 16. The dispenser base 12 may also be fabricated with an aperture 24 whereby the dispenser may be placed on a key ring, key chain, or the like. A latching mechanism 26 may be provided to retain the cover 14 in the closed position upon the base.

Figure 3:
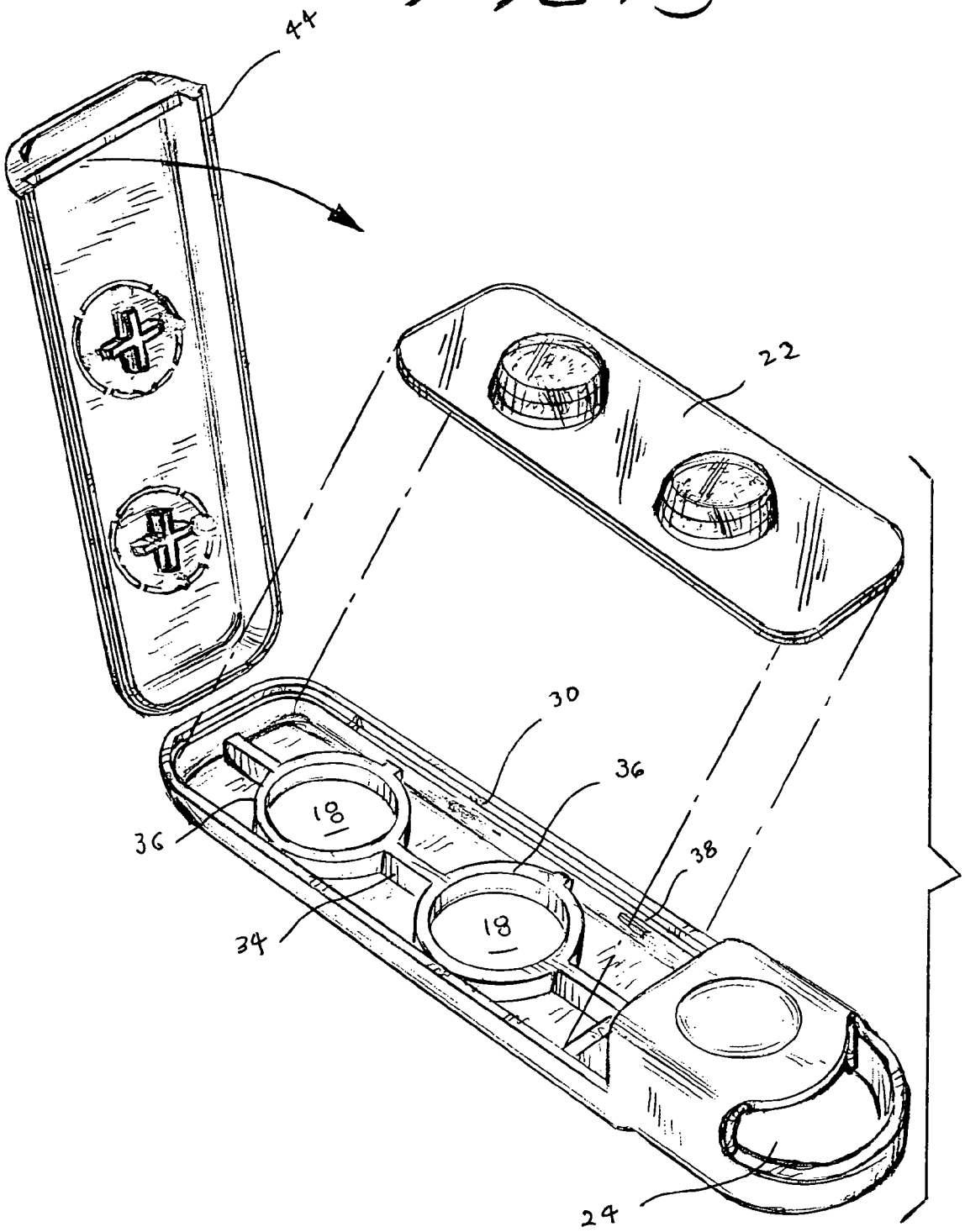
FIG. 3 is a perspective view of the dispenser in an open configuration, detailing the placement of a tablet carrier therein.

With further reference to FIGS. 2 and 3, base 12 incorporates a tray-like support for the blister pack 22, which rests upon an internal spine 34 extending upwardly from the base floor. The spine 34 includes circular portions 36 which define the walls for the ejection ports 18 and which are positioned to align with the tablets 20 in the blister pack. Preferably, the blister pack 22 is placed within the dispenser with the blisters thereof and the enclosed tablets facing upwards, in a direction opposed to the ejection ports 18 as depicted in the Figures. Internal tabs 38 may be provided on dispenser base sidewalls 32, spaced slightly above the height of the spine 34, to retain the blister pack in place, the lateral edges of the blister pack being caught under the tabs. The side wall 32 may also be provided with an internal peripheral ledge 30 which mates with a corresponding shoulder or flange 44 on the sidewall of the cover 14 to enhance the seal and alignment between the base and cover when the dispenser is closed.

Figure 4:
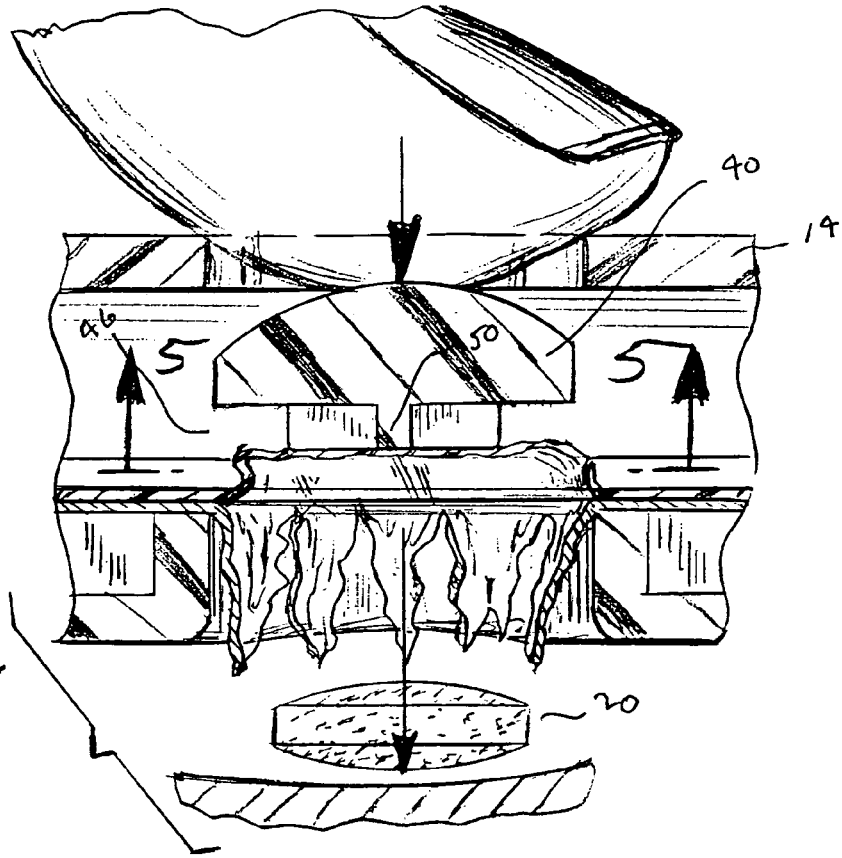
FIG. 4 is a detail sectional view depicting actuation of the dispenser for ejection of a tablet therefrom.
Figure 5:
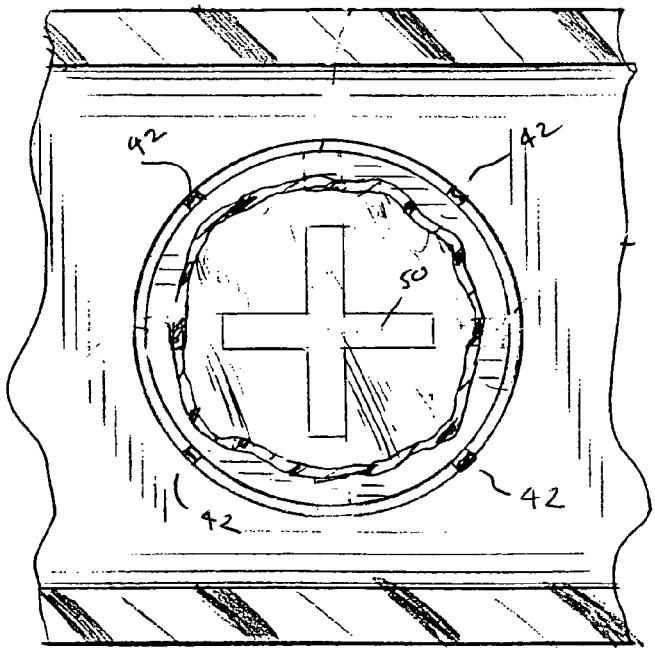
FIG. 5 is a section view taken along line 5-5 of FIG. 4 (the severed blister pack being omitted)

Referring to FIGS. 4 and 5, each of the ejectors 16 comprises a domed actuator 40 connected to the surrounding cover 14 by a series of legs 42. Preferably, the actuator, legs and cover are formed as an integral unit by an appropriate molding process. The legs support the actuator with its upper surface extending above the top surface of the surrounding cover, as best seen in FIG. 2, allowing the actuator to be easily located during use. The legs are preferably constructed such that, with downward pressure upon the actuator, as depicted in FIG. 4, the legs are severed, both allowing the ejector to move downward to eject the tablet and providing a clear indication that the corresponding tablet has been dispensed.

The actuator dome is preferably constructed with its bottom surface 46 supporting ribs 50, preferably arranged in a cruciform manner, the bottom surfaces of the ribs may be flat or slightly convex to apply force to the center of the blister positioned below the actuator and ribs. As seen in FIG. 2, the blister pack 22 is preferably of a construction in which the shape of the blister closely follows the upper contour of the tablet with minimal space between the blister and tablet. Such a construction minimizes deformation of the blister before the tablet is driven downward. In addition, the ribs 50 are dimensioned to provide a small preload upon the blister when the dispenser is closed. This assists in stabilizing the blister pack.

Figure 6:
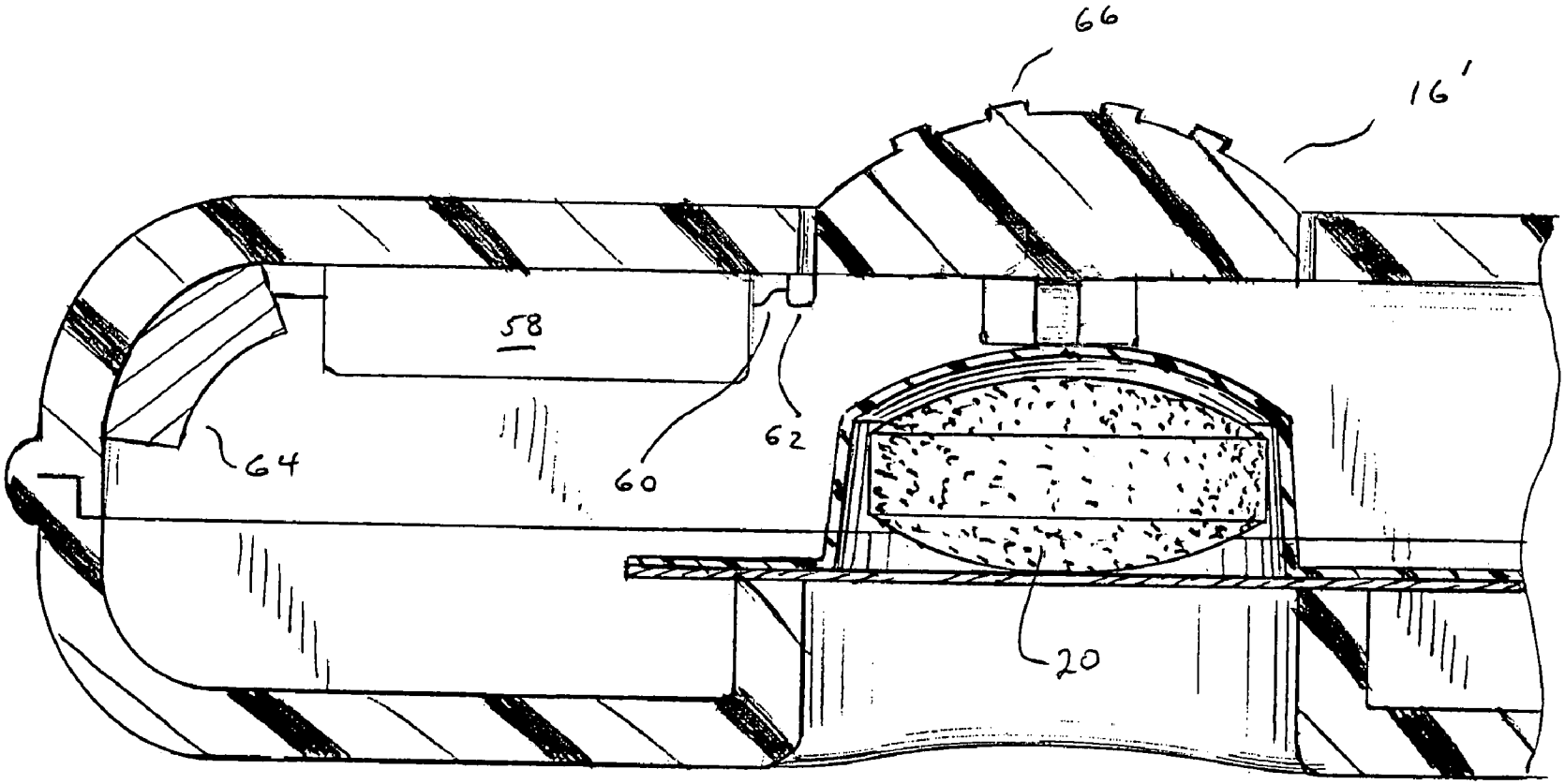
FIG. 6 is a partial sectional view corresponding to the left portion of FIG. 2, depicting the inclusion of electronic circuitry in the dispenser.

While the dispensation of an aspirin tablet upon the onset of a suspected heart attack may be of great aid to the stricken party, taking the tablet in an improper manner, or failing to seek timely aid, can result in potentially dire consequences. Accordingly, the present invention provides additional features to enhance and complement its aspirin-dispensing feature. As seen in FIG. 6, the dispenser 10 may be constructed with an elongated end portion, forming a chamber in which miniaturized electronic components may be carried to provide several different functions. Encapsulated circuit board 58, which may include an integral battery power supply, is connected by leads 60 to switch 62, configured to close or activate a circuit on circuit board 58 when the associated ejector 16' is operated. The circuit may be, for example, a pre-programmed voice synthesis circuit with a miniaturized speaker 64 that plays a set of prerecorded instructions upon actuated, such as instructions to chew, rather than swallow whole, the aspirin tablet, seek immediate medical care, etc. Alternatively, the circuit board 58 may support a preprogrammed cell phone dialer, allowing a radio call to be broadcast to a 911 or other facility, either with a capability for the user to engage in a conversation, using speaker 64 as a speaker and microphone, or by transmitting a stored message. Wireless GPS positioning technology may also be utilized to allow the location of the dispenser and hence the user to be pinpointed by the generation of an appropriate signal.

As shown, the circuit can be activated concurrently with the dispensation of a tablet. Alternatively, however, the dispenser can be configured whereby a tablet is not associated with the ejector 16', in which case the domed actuator 40 serves solely as an actuator for switch 62. In either case, where more that one actuator 40 is present it may be advantageous to configure the two actuators differently, such as by including raised indicia 66 on the actuator, to distinguish the circuit activator actuator from an actuator serving only to eject a tablet. The circuit can also be connected to a pair of switches 62 in parallel associated with separate actuators, allowing the circuitry to be enabled when either ejector is operated.

We claim:

1. A tablet dispenser, comprising:

a housing having first and second opposed top and bottom walls with an interior space therebetween dimensioned and adapted to receive a blister pack having at least one tablet therein and maintain the blister pack in a fixed position therein, the first and second walls being hinged together to allow access to the interior;

the first wall having at least one opening aligned with a tablet in the blister pack; and at least one ejector formed integrally with the second wall and aligned with a corresponding opening on the first wall for transmitting force to the blister pack to eject an aligned tablet from the blister pack and through the aligned opening, the ejector being connected in a frangible manner to surrounding portions of the second wall, whereby upon operation of the ejector the frangible connection is severed to prevent reuse of the ejector.

2. The tablet dispenser of claim 1 wherein the ejector is connected to the second wall by frangible ribs.

3. The tablet dispenser of claim 1 or 2 wherein the ejector comprises a domed actuator projecting above an outer surface of the second wall.

4. The tablet dispenser of claim 3 wherein the actuator is positioned to provide a preload against the blister pack, the blister pack being oriented with a blister facing the second wall.

5. The tablet dispenser of claim 4 wherein the blister has a top surface conforming to a top surface of a tablet within the blister.

6. The tablet dispenser of claim 4 wherein the actuator includes cruciform ribs extending downward to provide the preload.

7. The tablet dispenser of claim 1, further comprising switch means and means coupled to the switch for generating an electrical or audible signal upon switch activation.

8. The tablet dispenser of claim 7 wherein the switch is associated with an ejector.

9. The tablet dispenser of claim 7 or 8 wherein the audible signal is a set of instructions regarding a suspected heart attack.

10. The tablet dispenser of claim 9 wherein the instructions include instructions as to what to do with an ejected tablet.

11. The tablet dispenser of claim 7 or 8 wherein the electrical signal is a wireless signal allowing a position of the dispenser to be identified.

12. The tablet dispenser of claim 7 or 8 wherein the electrical signal is a 911 telephone call.

13. A tablet dispenser, comprising:

a housing having first and second opposed walls with an interior space therebetween dimensioned and adapted to receive a package having at least one tablet therein, the first wall having at least one opening aligned with a tablet in the pack;

at least one ejector aligned with a corresponding opening on the first wall for transmitting force to the blister pack to eject an aligned tablet from the blister pack and through the aligned opening; and switch means and means coupled to the switch for generating an audible signal in the form of a set of instructions regarding a suspected heart attack upon switch activation.

14. The tablet dispenser of claim 13 wherein the instructions include instructions as to what to do with an ejected tablet.

* * * * *